US008368313B2

(12) United States Patent
Liao et al.

(10) Patent No.: US 8,368,313 B2
(45) Date of Patent: Feb. 5, 2013

(54) ELECTRONIC CANDLE AND ELECTRONIC NIGHT LAMP

(75) Inventors: Tung-Tsai Liao, Hsin Chu (TW); Li Sheng Lo, Hsin Chu County (TW)

(73) Assignee: Generalplus Technology Inc., Hsinchu (TW)

( * ) Notice: Subject to any disclaimer, the term of this patent is extended or adjusted under 35 U.S.C. 154(b) by 581 days.

(21) Appl. No.: 12/362,959

(22) Filed: Jan. 30, 2009

(65) Prior Publication Data

US 2010/0007280 A1 Jan. 14, 2010

(30) Foreign Application Priority Data

Jul. 11, 2008 (TW) ..... 97126226 A

(51) Int. Cl.
*H05B 37/02* (2006.01)

(52) U.S. Cl. ..... 315/209 R; 315/158; 315/159; 315/225; 315/291; 315/307

(58) Field of Classification Search ..... 315/219, 315/282, 285, 902, 291, 224, 225, 307, 272, 315/222, 267
See application file for complete search history.

(56) References Cited

U.S. PATENT DOCUMENTS

| | | | | |
|---|---|---|---|---|
| 6,667,583 | B2 * | 12/2003 | Kerenyi | 315/219 |
| 6,762,607 | B2 * | 7/2004 | Kraz | 324/458 |
| 2003/0184237 | A1 * | 10/2003 | Togashi et al. | 315/169.3 |
| 2008/0218100 | A1 * | 9/2008 | Parikh | 315/306 |

* cited by examiner

*Primary Examiner* — Shawki Ismail
*Assistant Examiner* — Christopher Lo
(74) *Attorney, Agent, or Firm* — Muncy, Geissler, Olds & Lowe, PLLC

(57) ABSTRACT

The invention relates to an electronic candle and an electronic night lamp. The electronic candle includes a light-emitting diode (LED), a capacitor and a control circuit. The capacitor has a first terminal coupled to a first terminal of the LED, and a second terminal coupled to a common voltage. The control circuit has a first control terminal coupled to the first terminal of the LED, and a second control terminal coupled to a second terminal of the LED. In a detecting period, the control circuit provides a preset voltage across the first and second terminals of the LED so that the LED is reversely biased for a preset time. Then, the first control terminal of the control circuit is set to high impedance. Next, the control circuit detects a variation of a voltage of the first terminal of the capacitor with respect to time to determine whether to light up the LED.

22 Claims, 8 Drawing Sheets

ELECTRONIC CANDLE AND ELECTRONIC NIGHT LAMP

This application claims priority of No. 097126226 filed in Taiwan R.O.C. on Jul. 11, 2008 under 35 USC 119, the entire content of which is hereby incorporated by reference.

BACKGROUND OF THE INVENTION

1. Field of Invention

The present invention relates to the technology of a light-emitting diode (LED), and more particularly to an electronic candle and an electronic night lamp.

2. Related Art

After the industry revolution, the human beings use a lot of fossil fuel, deforest, use the carbide containing chlorine and fluorine and participate in the enlivened agrarian and industrial activities. Thus, the gases (i.e., the greenhouse gases GHG), such as carbon dioxide, methane, nitrous oxide, fluorine chlorine carbide, sulphur hexafluoride (SF6), perfluorocarbons (PFCs) and hydrogen fluorine carbide (HFCs), capable of absorbing the longwave radiation are greatly increased to cause the global warming phenomenon and thus the global greenhouse effect phenomenon. Because the global warming may dangerously cause the extremely abnormal influence of the global climate, and thus the significant impact on the deterioration of the ecology environment, the reduction of energy consumption is greatly pushed in various countries.

FIG. 1 shows a conventional electronic night lamp. Referring to FIG. 1, the electronic night lamp includes a light emitting element 101, a casing 102 and a light source detector 103. The light source detector 103 is mainly utilized to detect the environmental brightness, and the electronic night lamp may judge whether the light emitting element 101 is lighted up according to the detected environmental brightness.

A light dependent resistor is widely used in the light source detector 103. The main chemical substance of the light dependent resistor is cadmium sulfide (CdS) or cadmium selenide (CdSe). After the light dependent resistor is illuminated by light, its resistance value is decreased. The change of the resistance value of the light dependent resistor illuminated by the light becomes larger as the area of the CdS or CdSe deposition film of the light dependent resistor becomes larger. So, the deposition film usually has the zigzag shape to enlarge its area. FIG. 2 is a schematic illustration showing a structure of a conventional light dependent resistor.

However, the price of the light dependent resistor is very high. In addition, the European Union has published Restriction of Hazardous Substances (RoHS), which prohibits the import of the electronic apparatus containing lead, mercury, cadmium, hexavalent chromium, polybrominated biphenyl or polybrominated diphenyl ethers (PBDEs). In response to the new rule of the European Union, Bureau of Standards, Metrology & Inspection in Taiwan also has specified the "Particular Criteria Governing Designated Testing Laboratories For Hazardous Substances". Thus, the light dependent resistor containing the cadmium sulfide (CdS) or the cadmium selenide (CdSe) cannot satisfy the specifications of various countries. In addition, although the manufacturer for manufacturing the light dependent resistor has disclosed the cadmium-free light dependent resistor, its price is relatively high.

SUMMARY OF THE INVENTION

It is therefore an objective of the present invention to provide an electronic candle and an electronic night lamp, each of which has a shared light-emitting diode (LED) serving as a photo-sensitive element, and satisfying the environment protection rules.

To achieve the above-identified or other objectives, the present invention provides an electronic candle. The electronic candle includes a light-emitting diode (LED) and a control circuit. The control circuit has a first control terminal coupled to a first terminal of the LED, and a second control terminal coupled to a second terminal of the LED. In a detecting period, the control circuit provides a preset voltage across the first terminal and the second terminal of the LED to reversely bias the LED for a preset time. Then, the first control terminal of the control circuit is set to high impedance. Next, the control circuit detects a variation of a voltage of the first terminal of the LED with respect to time to determine whether to light up the LED.

The present invention provides an electronic night lamp including a light-emitting diode (LED) and a control circuit. The control circuit has a first control terminal coupled to a first terminal of the LED, and a second control terminal coupled to a second terminal of the LED. In a detecting period, the control circuit provides a preset voltage across the first terminal and the second terminal of the LED to reversely bias the LED for a preset time. Thereafter, the first control terminal of the control circuit is set to high impedance. Next, the control circuit detects a variation of a voltage of the first terminal of the LED with respect to time to determine whether to light up the LED.

In the electronic candle and the electronic night lamp according to the preferred embodiment of the present invention, the control circuit provides the reverse bias to the LED when the first terminal of the LED is a cathode, and the first control terminal of the control circuit provides a power voltage to the first terminal of the LED and the second control terminal of the control circuit provides a common voltage to the second terminal of the LED when the second terminal of the LED is an anode. In addition, in order to enhance the stability of operating the electronic candle and the electronic night lamp, the preferred embodiment further includes a capacitor having a first terminal coupled to the first terminal of the LED and a second terminal coupled to the common voltage.

In addition, in an advanced embodiment, the control circuit includes a comparator, a count circuit and a judging circuit. The comparator has a first input terminal for receiving the preset voltage, and a second input terminal coupled to the first control terminal of the control circuit. When a voltage of the first control terminal of the control circuit is lower than the preset voltage, a voltage level of a comparison signal outputted from an output terminal of the comparator is changed from a first saturation voltage to a second saturation voltage. The count circuit coupled to the output terminal of the comparator accumulates a count value every preset time from the detecting period until the voltage level of the comparison signal outputted from the output terminal of the comparator is changed from the first saturation voltage to the second saturation voltage. At this time, the count circuit stops counting and outputs the count value. The judging circuit coupled to the count circuit receives the count value. When the control circuit is disposed in the electronic candle and the count value is smaller than a preset value (it represents that a light source with a predetermined intensity approaches the electronic candle), the LED is controlled to emit light. When the control circuit is disposed in the electronic night lamp and the count value is greater than a preset value (it represents that the environmental brightness is darker), the judging circuit controls the LED to emit light.

In the electronic candle and the electronic night lamp according to the preferred embodiment of the present invention, when the first terminal of the LED is an anode and the second terminal of the LED is a cathode, the control circuit provides the reverse bias to the LED, the first control terminal of the control circuit provides the common voltage to the first terminal of the LED, and the second control terminal of the control circuit provides the power voltage to the second terminal of the LED.

In addition, in an advanced embodiment, the control circuit includes a comparator, a count circuit and a judging circuit. The comparator has a first input terminal for receiving the preset voltage, and a second input terminal coupled to the first control terminal of the control circuit. When the voltage of the first control terminal of the control circuit is higher than the preset voltage, a voltage level of a comparison signal outputted from an output terminal of the comparator is changed from a first saturation voltage to a second saturation voltage. The count circuit coupled to the output terminal of the comparator accumulates a count value every preset time from the detecting period until the voltage level of the comparison signal outputted from the output terminal of the comparator is changed from the first saturation voltage to the second saturation voltage. At this time, the count circuit stops counting and outputs the count value. The judging circuit coupled to the count circuit receives the count value. When the control circuit is disposed in the electronic candle and the count value is smaller than a preset value (it represents that a light source with a predetermined intensity approaches the electronic candle), the LED is controlled to emit light. When the control circuit is disposed in the electronic night lamp and the count value is greater than a preset value (it represents that the environmental brightness is darker), the judging circuit controls the LED to emit light.

The spirit of the present invention is to share one LED for emitting light and serving as a light emitting element and a photosensitive element. The environmental light source is sensed according to the property of different discharge times when the LED receives light and when the LED does not receive light. Thus, the present invention has the following advantages.

First, the cost can be saved.

Second, the environment protection rule can be satisfied.

Third, when the present invention is applied to the electronic candle, it can simulate the effect of lighting up the candle.

Fourth, when the present invention is applied to the electronic night lamp, the electronic night lamp can be automatically lighted up without a manual operation as long as the brightness of the environmental light is lower than a preset level.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
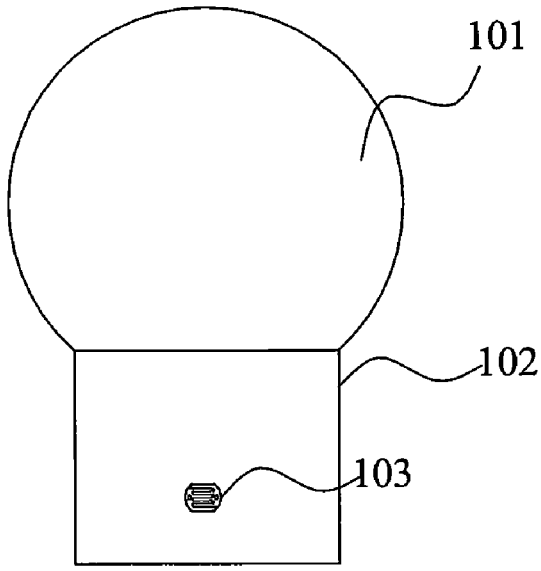
FIG. 1 (Prior Art)
FIG. 1 shows a conventional electronic night lamp.
Figure 2:
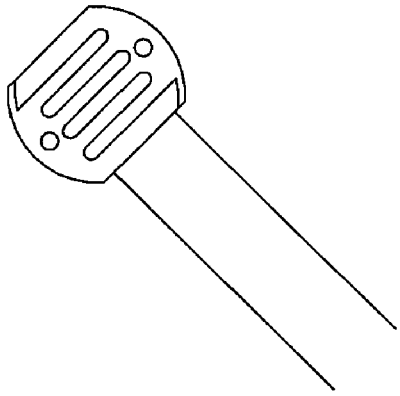
FIG. 2 (Prior Art)
FIG. 2 is a schematic illustration showing a structure of a conventional light dependent resistor.
Figure 3:
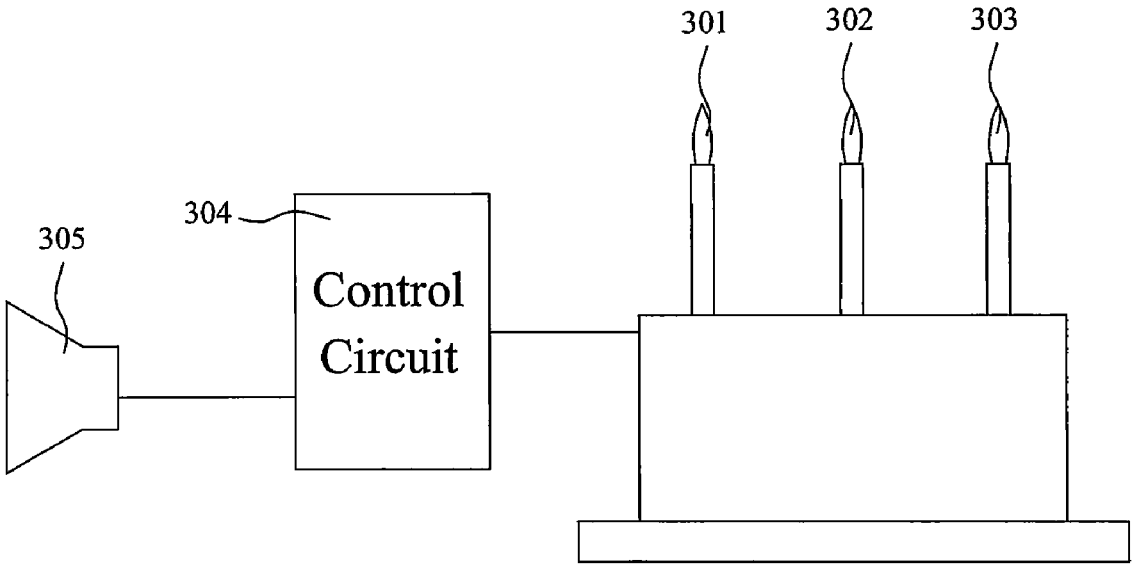
FIG. 3 is a schematic illustration showing an electronic cake according to an embodiment of the present invention.

FIG. 3 is a schematic illustration showing an electronic cake according to an embodiment of the present invention. Referring to FIG. 3, the electronic cake includes three LEDs 301 to 303, a control circuit 304 and a speaker 305. This application main utilizes the externally stronger light source, such as a LED, as a virtual lighter. When this virtual lighter approaches any electronic candle, such as one of the LEDs 301 to 303, the LED 301, 302 or 303 is lighted up, and the speaker 305 starts to play a song of "Happy Birthday To You". The embodiments will be illustrated to describe the spirit of the present invention.

Figure 4:
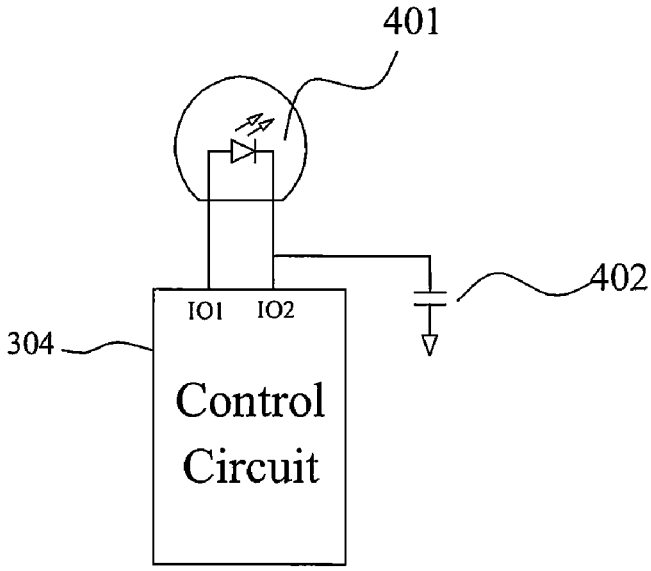
FIG. 4 is a circuit diagram showing an electronic candle according to the embodiment of the present invention.

FIG. 4 is a circuit diagram showing an electronic candle according to the embodiment of the present invention. Referring to FIG. 4, the electronic candle includes a LED 401, the control circuit 304 and a capacitor 402. The LED 401 may be regarded as one of the LEDs 301 to 303. When the electronic candle is detecting light, the control circuit 304 provides the LED 401 a reverse bias for a preset time through its control terminals IO1 and IO2. Generally speaking, a ground voltage is provided to the anode of the LED 401, and a power voltage is provided to the cathode of the LED 401. Thereafter, the control terminal IO2 of the control circuit 304 is set to high impedance, and the control terminal IO1 of the control circuit 304 is set to the ground voltage.

Figure 5:
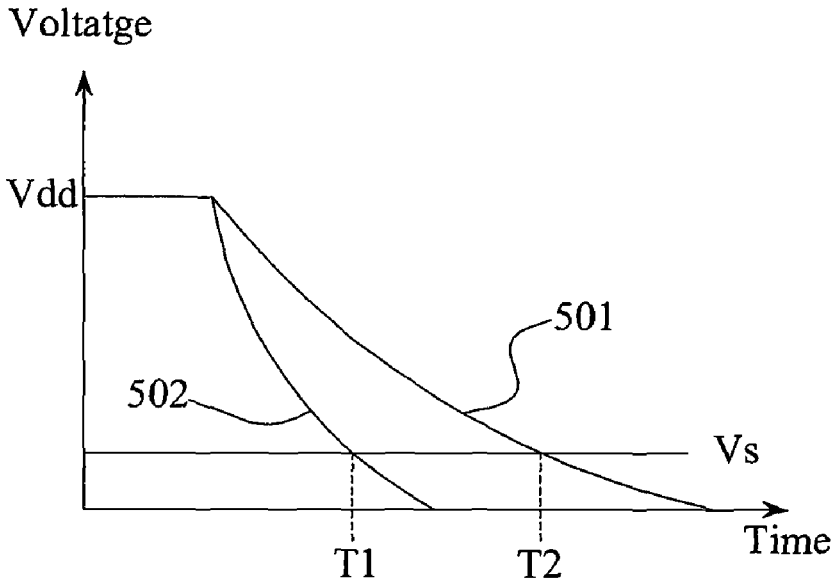
FIG. 5 shows charge/discharge waveforms of a capacitor 402 according to the embodiment of the present invention.

FIG. 5 shows charge/discharge waveforms of the capacitor 402 according to the embodiment of the present invention. Referring next to FIG. 5, a little photoelectric current is generated when the reversely biased LED 401 is illuminated. Thus, the capacitor 402 is slowly discharged, and the voltage of the cathode of the LED 401 is also lowered therewith. A waveform 501 is a discharge waveform when no light source approaches the LED 401. A waveform 502 is a discharge waveform when a light source approaches the LED 401. According to the waveform, it is obtained that the photoelectric current is generated after the LED 401 is illuminated by light, and the photoelectric current gets higher as the illuminating intensity of the light becomes stronger. Thus, the rate of discharging the capacitor 402 is increased. When the LED 401 is not illuminated by the light, the rate of discharging the capacitor 402 becomes slower.

According to the waveforms 501 and 502, whether the light source approaches the LED 401 can be obtained as long as the voltage of the first terminal of the capacitor 402 (the cathode of the LED 401) is continuously detected. Thus, a preset voltage Vs, ranging between the power voltage and the ground voltage, may be preset in the control circuit 304 during the design phase. The control circuit 304 only has to count the time period from the time when the voltage of the first terminal of the capacitor 402 is the power voltage Vdd to the time when the voltage of the first terminal of the capacitor 402 reaches the preset voltage Vs, and can thus know whether the light source approaches the LED 401. Thus, in this embodiment, the control circuit 304 provides a reverse bias to the LED 401 for a preset time in the detecting period so that the capacitor 402 is charged. Thereafter, the control terminal IO2 of the control circuit 304 is set to the high impedance. Next, the control circuit 304 determines whether to provide the forward bias to the LED 401 according to the time when the voltage of the first terminal of the capacitor 402 reaches a preset voltage Vs. If the time when the voltage of the first terminal of the capacitor 402 reaches the preset voltage Vs is smaller than T2, it represents that the light source has illuminated the LED 401. At this time, the forward bias can be provided to the LED 401 to light up the LED.

Figure 6:
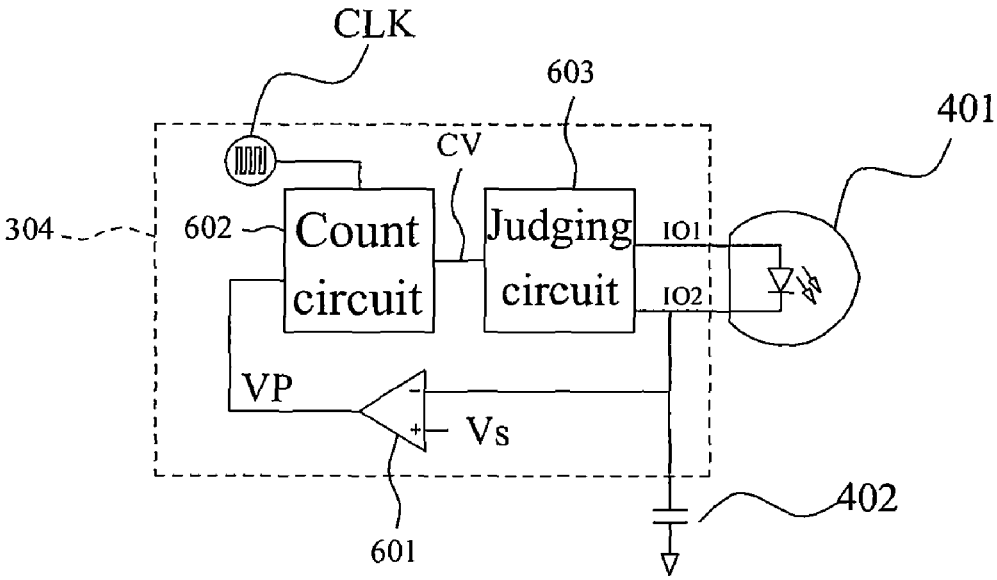
FIG. 6 is a detailed circuit diagram showing the electronic candle according to the embodiment of the present invention.

FIG. 6 is a detailed circuit diagram showing the electronic candle according to the embodiment of the present invention. Referring to FIG. 6, the electronic candle of this embodiment includes the LED 401, the capacitor 402 and the control circuit 304. The control circuit 304 of this embodiment includes a comparator 601, a count circuit 602 and a judging circuit 603. The positive terminal of the comparator 601 receives the preset voltage Vs, and the negative terminal of the comparator 601 is coupled to the control terminal IO2 of the control circuit 304.

When sensing starts, the capacitor 402 discharges the control terminal IO1 through the LED 401. At this time, a comparison signal VP outputted from the output terminal of the comparator 601 is a negative saturation voltage. When the capacitor 402 is discharged to a voltage lower than the preset voltage Vs, the voltage of the control terminal IO2 (i.e., the voltage of the negative terminal of the comparator 601 is smaller than the voltage Vs of the positive terminal of the comparator 601), the comparison signal VP outputted from the output terminal of the comparator 601 is the positive saturation voltage. The count circuit 602 accumulates a count value CV each preset time (the time of one clock CLK) from the detecting period until the comparison signal VP outputted from the output terminal of the comparator 601 is changed from the negative saturation voltage to the positive saturation voltage. At this time, the counting is stopped and the count value CV is outputted. According to the above-mentioned embodiment, it is obtained that the count value CV actually represents the discharge time, for which the voltage of the capacitor 402 is discharged from the power voltage Vdd to the preset voltage Vs. When the voltage discharge of the capacitor 402 is quicker, it represents that the LED 401 is illuminated by the light source, and the count value CV becomes smaller. When the voltage discharge of the capacitor 402 is slower, the LED 401 is not illuminated by the light source, and the count value CV becomes larger. The judging circuit 603 receives the count value CV. When the count value CV is smaller than a preset value, it represents that the LED 401 is illuminated by the light source, and the judging circuit 603 controls the LED 401 to emit light.

Figure 7:
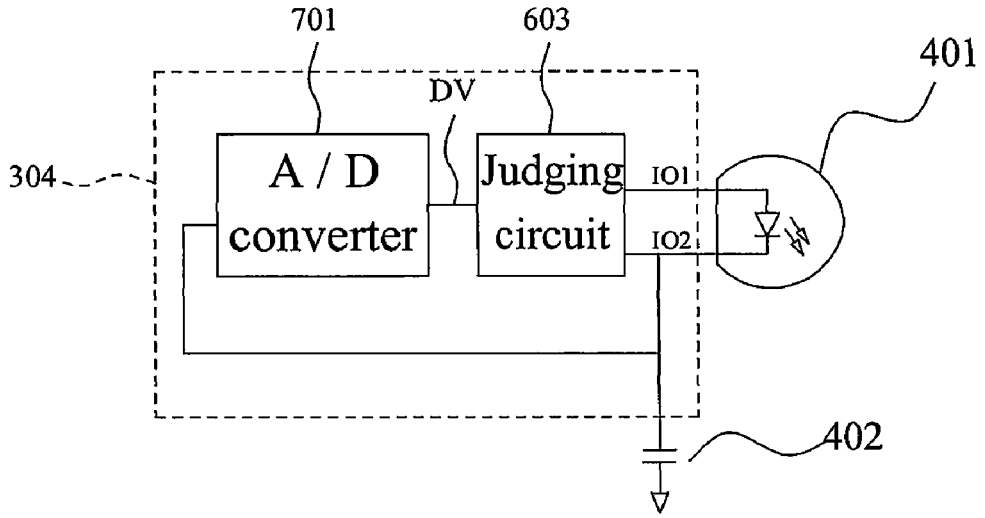
FIG. 7 is another circuit diagram showing the electronic candle of FIG. 4 according to the embodiment of the present invention.
Figure 8:
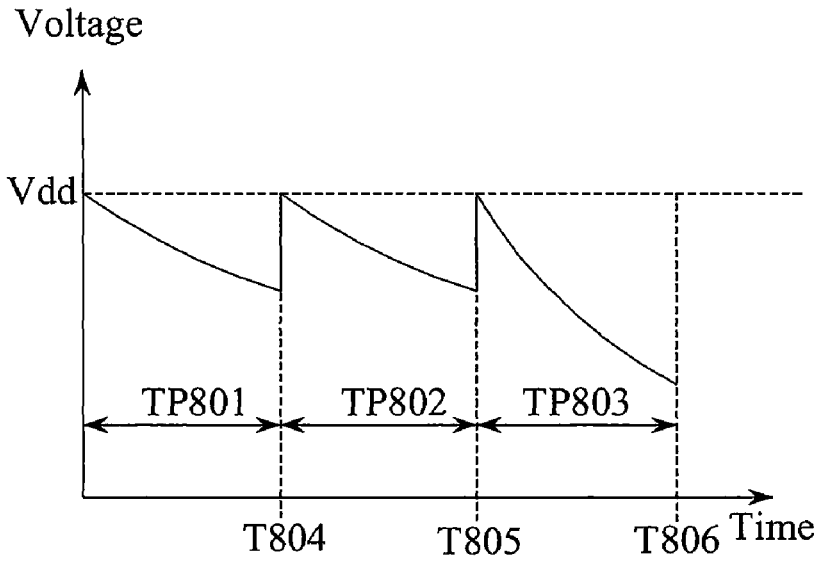
FIG. 8 shows voltage waveforms of a control terminal IO2 in FIG. 7 according to the embodiment of the present invention.

FIG. 7 is another circuit diagram showing the electronic candle of FIG. 4 according to the embodiment of the present invention. As shown in FIG. 7, the different between this embodiment and the embodiment of FIG. 6 is that an analog-to-digital converter 701 is provided to replace the comparator 601 and the count circuit 602. FIG. 8 shows voltage waveforms of the control terminal IO2 in FIG. 7 according to the embodiment of the present invention. Referring to FIGS. 7 and 8, the periods TP801, TP802 and TP803 are the same as one another in this embodiment. The LED 401 is not illuminated by the light in the period TP801 and the period TP802, and the LED 401 is illuminated by the light in the period TP803. As can be easily seen from the above-mentioned waveforms, whether the LED 401 is illuminated by the light influences the finally stored charges of the capacitor 402 (i.e., the voltage of the control terminal IO2) when the periods are the same. The analog-to-digital converter 701 samples the voltage of the control terminal IO2 in each of the final times T803, T804 and T805, and converts the voltage into a digital value DV. Generally speaking, the digital value DV gets greater as the voltage gets higher. Thus, when the LED 401 is illuminated by the light, the digital value obviously becomes smaller. In this embodiment, a preset value is stored in the judging circuit 603. When the digital value DV is smaller than the preset value, it represents that the LED 401 is illuminated by the light, and the judging circuit 603 controls the LED 401 to emit light.

Figure 9:
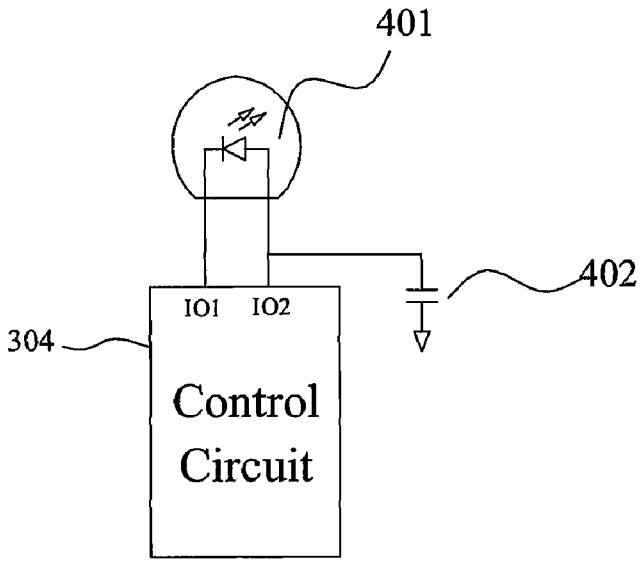
FIG. 9 is a circuit diagram showing an electronic candle according to the embodiment of the present invention.

In the above-mentioned embodiment, one of ordinary skill in the art should know that if the positive and negative terminals of the comparator 601 are exchanged, the difference only resides in the exchange between the positive and negative saturation voltages of the outputted comparison signal VP. Thus, the operations may be the same as long as the stop counting condition of the count circuit 602 is changed to that the comparison signal VP is changed from the positive saturation voltage to the negative saturation voltage. Similar designs only pertain to the design choices, so detailed descriptions thereof will be omitted. In addition, if the circuit of the FIG. 4 is modified into the circuit of FIG. 9 (i.e., when the cathode of the LED 401 is coupled to the control terminal IO1 and the anode of the LED 401 is coupled to the control terminal IO2), the control method is changed to that the control terminal IO1 provides the power voltage Vdd, and the control terminal IO2 provides the ground voltage and is then set to the high impedance. The voltage waveforms of the control terminal IO2 are depicted in FIG. 10.

Figure 10:
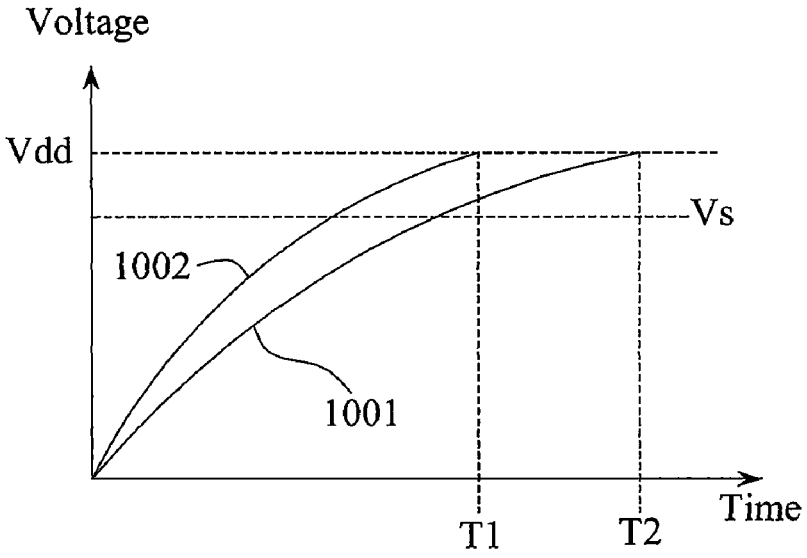
FIG. 10 shows voltage waveforms of the control terminal IO2 in FIG. 9 according to the embodiment of the present invention.
Figure 11:
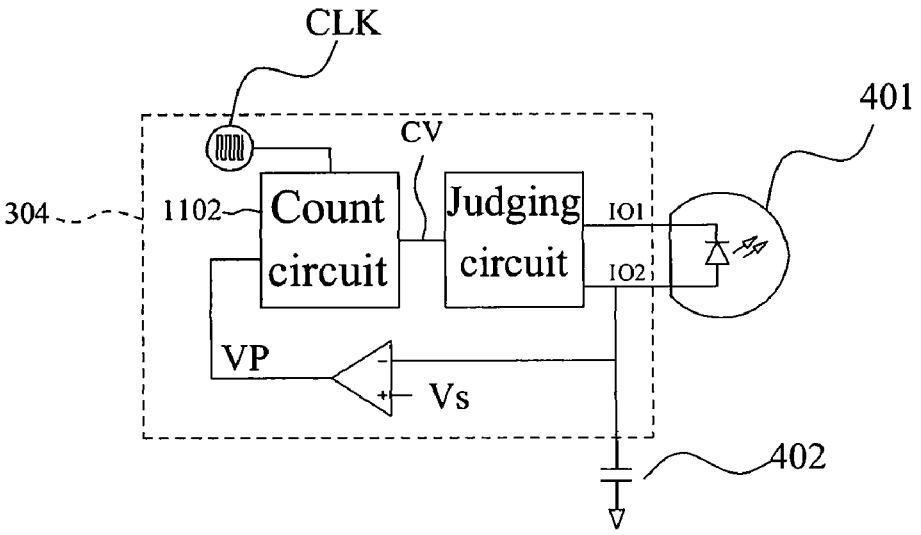
FIG. 11 is a detailed circuit diagram showing the electronic candle of FIG. 10 according to the embodiment of the present invention.

FIG. 11 is a detailed circuit diagram showing the electronic candle of FIG. 10 according to the embodiment of the present invention. As shown in FIGS. 11 and 6, the difference between the two circuits only resides in that the connections of the cathode and the anode of the LED 401 in FIG. 11 are reverse to those in FIG. 6. Thus, during sensing, the capacitor 402 is discharged to the ground voltage, and then the control terminal IO1 continuously supplies the power voltage Vdd to charge the capacitor 402. When the voltage of the control terminal IO2 is charged to reach the preset voltage Vs, the comparison signal VP is changed from the positive saturation voltage to the negative saturation voltage, and a count circuit 1102 also stops counting. The operation principle of the circuit of FIG. 11 is substantially the same as that of FIG. 6, so detailed descriptions thereof will be omitted.

Figure 12:
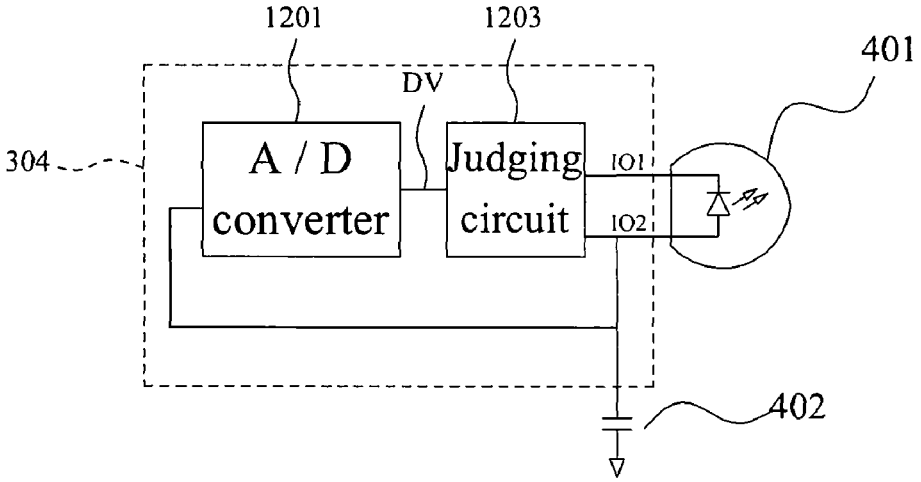
FIG. 12 is another circuit diagram showing the electronic candle of FIG. 10 according to the embodiment of the present invention.
Figure 13:
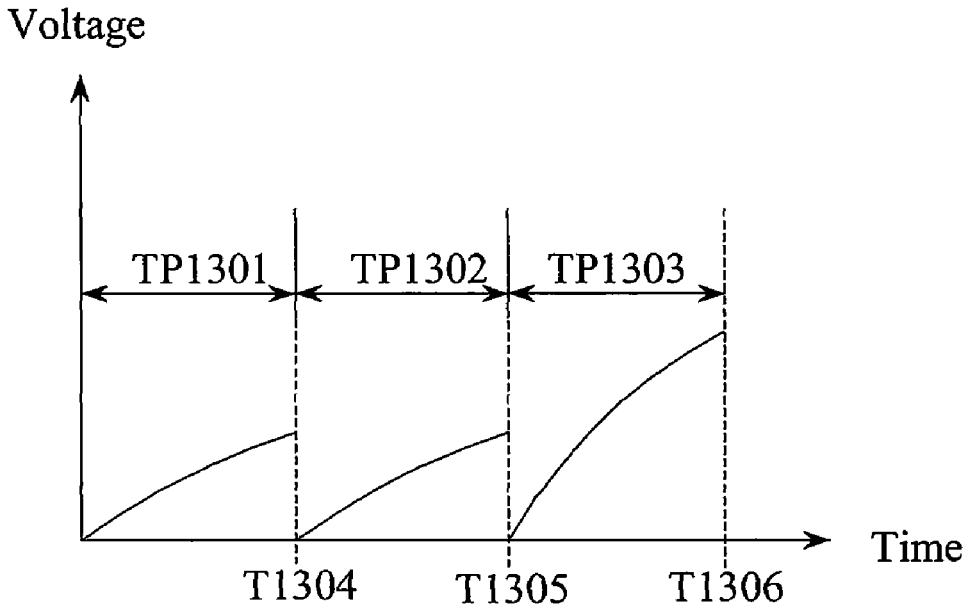
FIG. 13 shows voltage waveforms of the control terminal IO2 of FIG. 12 according to the embodiment of the present invention.

FIG. 12 is another circuit diagram showing the electronic candle of FIG. 10 according to the embodiment of the present invention. FIG. 13 shows voltage waveforms of the control terminal IO2 of FIG. 12 according to the embodiment of the present invention. Similarly, referring to FIGS. 12, 7 and 8, the difference between FIGS. 7 and 12 only resides in that the connections of the cathode and the anode of the LED 401 in FIG. 12 are reverse to those in FIG. 7. Similarly, the LED 401 does not receive the illuminated light in the periods TP1301 and TP1302, and the control terminal IO2 is charged at the slower rate. Thus, the voltages of the control terminal IO2 measured at the time instants T1304 and T1305 are lower, and the digital value DV outputted from an analog-to-digital converter 1201 is smaller. At this time, a judging circuit 1203 does not light up the LED 401. In the period TP1303, the LED 401 is illuminated by the light, and the control terminal IO2 is charged at the higher rate. Thus, the voltage of the control terminal IO2 measured at the time instant T1306 is higher, the digital value DV outputted from the analog-to-digital converter 1201 is relatively large, and the judging circuit 1203 is triggered to light up the LED 401.

In addition to the utilization of the light source to simulate the operation of lighting up the candle, a speaker may be coupled to the control circuit in order to broaden the application of the electronic candle. Thus, when the electronic candle is lighted up, the song of "Happy Birthday To You" may be outputted.

Figure 14:
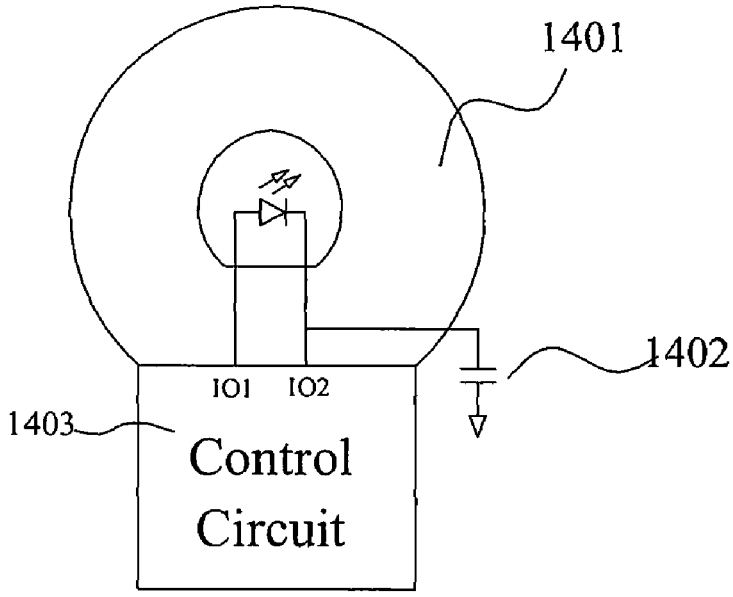
FIG. 14 is a circuit diagram showing an electronic night lamp according to the embodiment of the present invention.

FIG. 14 is a circuit diagram showing an electronic night lamp according to the embodiment of the present invention. Referring to FIG. 14, the electronic night lamp includes a LED 1401, a capacitor 1402 and a control circuit 1403. Next, compared the circuit diagram with the circuit of FIG. 4, the circuit is similar to the circuit architecture of FIG. 4 except that the control methods are different from each other. Because the required function of the night lamp is that the night lamp may be lighted up when the light becomes dark and may be extinguished when the light becomes bright. Thus, the circuit architecture still may be similar to the circuits and the operation principles in FIGS. 4 to 13 except for the change of the control method. For example, when the circuit architecture of the electronic night lamp is implemented by the circuit in FIG. 6 or 11, the count value CV received by the judging circuit 603 has to be greater than the preset value so that the night lamp can be lighted up. When the circuit architecture of the electronic night lamp is implemented by the circuit of FIG. 7, the digital value received by the judging circuit 603 has to be greater than the preset value so that the night lamp may be lighted up. When the circuit architecture of the electronic night lamp is implemented by the circuit of FIG. 12, the digital value received by the judging circuit 1203 has to be smaller than the preset value so that the night lamp may be lighted up.

Figure 15:
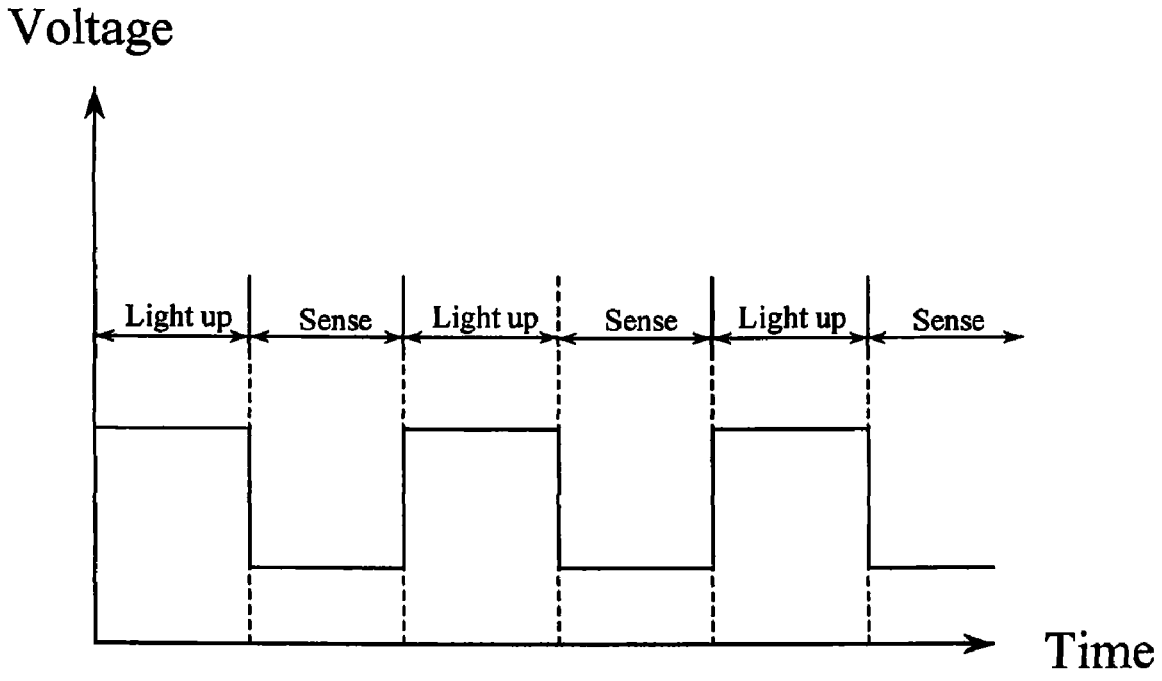
FIG. 15 shows control timings for the electronic night lamp according to the embodiment of the present invention.

In addition, the required maximum difference between the circuit of the electronic night lamp and the circuit of the electronic candle resides in that the LED 1401 has to be extinguished when the environmental brightness becomes bright in the electronic candle. In this embodiment, the night lamp operates in a time division multiplexing (TDM) manner. FIG. 15 shows control timings for the electronic night lamp according to the embodiment of the present invention. As shown in FIG. 15, after electronic night lamp of FIG. 14 according to the embodiment of the present invention is lighted up, the LED 1401 is lighted up for a period of time, and is reversely biased for another period of time to sense whether the brightness of the environment light source is changed according to the timings. As long as the timings are fast enough, the human eyes cannot feel the flicker. Thus, the same LED 1401 may be utilized to sense the light and emit the light.

In the above-mentioned two embodiments, one terminal of the LED is coupled to the capacitor, and the control circuit controls the two products to emit light or not according to the relationship between the charge/discharge time and the voltage of the capacitor. However, one of ordinary skill in the art may easily understand that the printed circuit board and the LED also have stray capacitors even if no capacitor is coupled. Thus, the capacitor should not be limited to the physical capacitor, and the present invention should not be limited thereto.

In summary, the spirit of the present invention is to share one LED for emitting light and serving as a light emitting element and a photosensitive element. The environmental light source is sensed according to the property of different discharge times when the LED receives light and when the LED does not receive light. Thus, the present invention has the following advantages.

First, the cost can be saved.

Second, the environment protection rule can be satisfied.

Third, when the present invention is applied to the electronic candle, it can simulate the effect of lighting up the candle.

Fourth, when the present invention is applied to the electronic night lamp, the electronic night lamp can be automatically lighted up without a manual operation as long as the brightness of the environmental light is lower than a preset level.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. An electronic candle, comprising:

a light-emitting diode (LED) having a first terminal and a second terminal; and a control circuit having a first control terminal coupled to the first terminal of the LED, and a second control terminal coupled to the second terminal of the LED, wherein in a detecting period, the control circuit provides a reverse bias across the first terminal and the second terminal of the LED for a preset time, then the first control terminal of the control circuit is set to high impedance, and then the control circuit detecting a variation of a voltage of the first terminal of the LED with respect to time to determine an environmental luminance, and then the control circuit determines whether to provide a forward bias to the LED according to the environmental luminance.

2. The electronic candle according to claim 1, further comprising:

a capacitor having a first terminal coupled to the first terminal of the LED, and a second terminal coupled to a common voltage.

3. The electronic candle according to claim 1, wherein the first terminal of the LED is a cathode, and the second terminal of the LED is an anode.

4. The electronic candle according to claim 3, wherein when the control circuit provides the reverse bias to the LED, the first control terminal of the control circuit provides a power voltage to the first terminal of the LED, and the second control terminal of the control circuit provides a common voltage to the second terminal of the LED.

5. The electronic candle according to claim 4, wherein the control circuit comprises:

a comparator comprising a first input terminal, a second input terminal and an output terminal, wherein the first input terminal of the comparator receives a preset voltage, the second input terminal of the comparator is coupled to the first control terminal of the control circuit, and when a voltage of the first control terminal of the control circuit is lower than the preset voltage, a voltage level of a comparison signal outputted from the output terminal of the comparator is changed from a first saturation voltage to a second saturation voltage;

a count circuit, coupled to the output terminal of the comparator, for accumulating a count value every preset time from the detecting period until the voltage level of the comparison signal outputted from the output terminal of the comparator is changed from the first saturation voltage to the second saturation voltage, and then stopping counting to output the count value; and a judging circuit, coupled to the count circuit, for receiving the count value, wherein when the count value is smaller than a preset value, the LED is controlled to emit light.

6. The electronic candle according to claim 4, wherein the control circuit comprises:

an analog-to-digital converter comprising an input terminal and an output terminal, wherein the input terminal of the analog-to-digital converter is coupled to the first control terminal of the control circuit, and the analog-to-digital converter outputs a digital value according to a voltage of the first control terminal of the control circuit within a predetermined time before the detecting period ends; and a judging circuit, coupled to the analog-to-digital converter, for receiving the digital value, wherein the LED is controlled to emit light when the digital value is smaller than a preset value.

7. The electronic candle according to claim 1, wherein the first terminal of the LED is an anode, and the second terminal of the LED is a cathode.

8. The electronic candle according to claim 7, wherein when the control circuit provides the reverse bias to the LED, the first control terminal of the control circuit provides a common voltage to the first terminal of the LED, and the second control terminal of the control circuit provides a power voltage to the second terminal of the LED.

9. The electronic candle according to claim 8, wherein the control circuit comprises:

a comparator comprising a first input terminal, a second input terminal and an output terminal, wherein the first input terminal of the comparator receives a preset voltage, the second input terminal of the comparator is coupled to the first control terminal of the control circuit, and when a voltage of the first control terminal of the control circuit is higher than the preset voltage, a voltage level of a comparison signal outputted from the output terminal of the comparator is changed from a first saturation voltage to a second saturation voltage;

a count circuit, coupled to the output terminal of the comparator, for accumulating a count value every preset time from the detecting period until the voltage level of the comparison signal outputted from the output terminal of the comparator is changed from the first saturation voltage to the second saturation voltage, and then stopping counting to output the count value; and a judging circuit, coupled to the count circuit, for receiving the count value, wherein when the count value is smaller than a preset value, the LED is controlled to emit light.

10. The electronic candle according to claim 8, wherein the control circuit comprises:

an analog-to-digital converter comprising an input terminal and an output terminal, wherein the input terminal of the analog-to-digital converter is coupled to the first control terminal of the control circuit, and the analog-to-digital converter outputs a digital value according to a voltage of the first control terminal of the control circuit within a predetermined time before the detecting period ends; and a judging circuit, coupled to the analog-to-digital converter, for receiving the digital value and controlling the LED to emit light when the digital value is greater than a preset value.

11. The electronic candle according to claim 1, further comprising:

a speaker coupled to the control circuit for controlling the speaker to output a preset melody after the LED is lighted up.

12. An electronic night lamp, comprising:

a light-emitting diode (LED) having a first terminal and a second terminal; and a control circuit having a first control terminal coupled to the first terminal of the LED, and a second control terminal coupled to the second terminal of the LED, wherein in a detecting period, the control circuit provides a reverse bias across the first terminal and the second terminal of the LED for a preset time, then the first control terminal of the control circuit is set to high impedance, and then the control circuit detecting a variation of a voltage of the first terminal of the LED with respect to time to determine an environmental luminance, and then the control circuit determines whether to provide the LED a forward bias according to the environmental luminance.

13. The electronic night lamp according to claim 12, further comprising:

a capacitor having a first terminal coupled to the first terminal of the LED, and a second terminal coupled to a common voltage.

14. The electronic night lamp according to claim 12, wherein the first terminal of the LED is a cathode, and the second terminal of the LED is an anode.

15. The electronic night lamp according to claim 14, wherein when the control circuit provides the reverse bias to the LED, the first control terminal of the control circuit provides a power voltage to the first terminal of the LED, and the second control terminal of the control circuit provides a common voltage to the second terminal of the LED.

16. The electronic night lamp according to claim 15, wherein the control circuit comprises:

a comparator comprising a first input terminal, a second input terminal and an output terminal, wherein the first input terminal of the comparator receives a preset voltage, the second input terminal of the comparator is coupled to the first control terminal of the control circuit, and when a voltage of the first control terminal of the control circuit is lower than the preset voltage, a voltage level of a comparison signal outputted from the output terminal of the comparator is changed from a first saturation voltage to a second saturation voltage;

a count circuit, coupled to the output terminal of the comparator, for accumulating a count value every preset time from the detecting period until the voltage level of the comparison signal outputted from the output terminal of the comparator is changed from the first saturation voltage to the second saturation voltage, and then stopping counting to output the count value; and a judging circuit, coupled to the count circuit, for receiving the count value and controlling the LED to emit light when the count value is greater than a preset value.

17. The electronic night lamp according to claim 15, wherein the control circuit comprises:

an analog-to-digital converter comprising an input terminal and an output terminal, wherein the input terminal of the analog-to-digital converter is coupled to the first control terminal of the control circuit, and the analog-to-digital converter outputs a digital value according to a voltage of the first control terminal of the control circuit within a predetermined time before the detecting period ends; and a judging circuit, coupled to the analog-to-digital converter, for receiving the digital value and controlling the LED to emit light when the digital value is smaller than a preset value.

18. The electronic night lamp according to claim 12, wherein the first terminal of the LED is an anode, and the second terminal of the LED is a cathode.

19. The electronic night lamp according to claim 18, wherein when the control circuit provides the reverse bias to the LED, the first control terminal of the control circuit provides a common voltage to the first terminal of the LED, and the second control terminal of the control circuit provides a power voltage to the second terminal of the LED.

20. The electronic night lamp according to claim 19, wherein the control circuit comprises:

a comparator comprising a first input terminal, a second input terminal and an output terminal, wherein the first input terminal of the comparator receives a preset voltage, the second input terminal of the comparator is coupled to the first control terminal of the control circuit, and when a voltage of the first control terminal of the control circuit is higher than the preset voltage, a voltage level of a comparison signal outputted from the output terminal of the comparator is changed from a first saturation voltage to a second saturation voltage;

a count circuit, coupled to the output terminal of the comparator, for accumulating a count value every preset time from the detecting period until the voltage level of the comparison signal outputted from the output terminal of the comparator is changed from the first saturation voltage to the second saturation voltage, and then stopping counting to output the count value; and a judging circuit, coupled to the count circuit, for receiving the count value and controlling the LED to emit light when the count value is greater than a preset value.

21. The electronic night lamp according to claim 19, wherein the control circuit comprises:

an analog-to-digital converter comprising an input terminal and an output terminal, wherein the input terminal of the analog-to-digital converter is coupled to the first control terminal of the control circuit, and the analog-to-digital converter outputs a digital value according to a voltage of the first control terminal of the control circuit within a predetermined time before the detecting period ends; and a judging circuit, coupled to the analog-to-digital converter, for receiving the digital value and controlling the LED to emit light when the digital value is greater than a preset value.

22. The electronic night lamp according to claim 12, wherein:

when the LED is controlled to emit light, a control timing of the control circuit is divided into the detecting period and a lighting period; and in the lighting period, the control circuit provides the forward bias to the LED to make the LED output the light.

* * * * *